US006804936B2

(12) United States Patent
Kurth

(10) Patent No.: US 6,804,936 B2
(45) Date of Patent: Oct. 19, 2004

(54) METHOD FOR PRESTERILIZING A TUBULAR POUCH PACKING MACHINE

(75) Inventor: Gunter Kurth, Ranstadt (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 0 days.

(21) Appl. No.: 10/275,626

(22) PCT Filed: Nov. 7, 2001

(86) PCT No.: PCT/DE01/04202

§ 371 (c)(1),
(2), (4) Date: Nov. 6, 2002

(87) PCT Pub. No.: WO03/039966

PCT Pub. Date: May 15, 2003

(65) Prior Publication Data

US 2004/0011004 A1 Jan. 22, 2004

(51) Int. Cl.[7] ..... B65B 55/10

(52) U.S. Cl. ..... 53/426; 53/167; 53/451; 53/551; 422/27

(58) Field of Search ..... 53/425, 426, 167, 53/451, 551, 552, 141; 422/26–28

(56) References Cited

U.S. PATENT DOCUMENTS

| | | | | | |
|---|---|---|---|---|---|
| 3,086,336 | A | * | 4/1963 | Rausing et al. | 53/167 |
| 3,854,874 | A | | 12/1974 | Loliger et al. | |
| 3,970,426 | A | * | 7/1976 | Stark et al. | 422/28 |
| 4,045,939 | A | | 9/1977 | Baumstingl | |
| 4,537,007 | A | | 8/1985 | Lattanzi | |
| 4,656,813 | A | * | 4/1987 | Baldini et al. | 53/426 |
| 4,783,947 | A | * | 11/1988 | Posey et al. | 53/426 |
| 4,874,021 | A | * | 10/1989 | Ringdahl et al. | 141/85 |
| 4,888,155 | A | * | 12/1989 | Posey et al. | 422/28 |
| 5,044,140 | A | * | 9/1991 | Iwano et al. | 53/426 |
| 5,173,259 | A | * | 12/1992 | Bordini | 422/28 |
| 5,335,479 | A | * | 8/1994 | Lemke et al. | 53/426 |
| 6,009,684 | A | * | 1/2000 | Buesing | 422/28 |
| 6,438,929 | B2 | * | 8/2002 | Kume et al. | 53/552 |
| 6,638,476 | B1 | * | 10/2003 | Elias et al. | 422/28 |

FOREIGN PATENT DOCUMENTS

| | | | | |
|---|---|---|---|---|
| DE | 19510555 | | 2/1996 | |
| DE | 19910485 | | 9/2000 | |
| EP | 0232943 | | 10/2000 | |
| GB | 832595 | | 4/1960 | |
| JP | 01267132 A | * | 10/1989 | B65B/55/10 |

* cited by examiner

*Primary Examiner*—Stephen F. Gerrity
(74) *Attorney, Agent, or Firm*—Collard & Roe, P.C.

(57) ABSTRACT

For pre-sterilizing a tubular bag packing machine to be operated under sterile conditions after the pre-sterilization phase, following the steam sterilization of the device metering the loading material and forming part of the machine, and of the forming pipe simultaneously serving as a filling pipe, the subsequent supply of sterile air to the meter, to the forming pipe and to the sterile chamber will be maintained. The longitudinally sealed tube of packing material formed on the forming pipe from the web of packing material is kept open underneath the opening of the sterile chamber in order to allow both the sterile air and the mixture of steam and sterilization agent conducted after pre-sterilization of the metering device into the sterile chamber to be discharged through the forming pipe and the tube of packing material open at the bottom.

5 Claims, 3 Drawing Sheets

METHOD FOR PRESTERILIZING A TUBULAR POUCH PACKING MACHINE

CROSS REFERENCE TO RELATED APPLICATIONS

Applicant claims priority under 35 U.S.C. §119 of PCT/DE01/04202 filed on 7 Nov. 2001. Applicant also claims priority under 35 U.S.C. §365 of PCT/DE01/04202 filed on 7 Nov. 2001. The international application under PCT article 21(2) was not published in English.

BACKGROUND OF THE INVENTION

1. Field of the Invention

The present invention is concerned with a method of manufacturing and loading of so-called tubular bags under sterile conditions; in particular, it relates to pre-sterilizing a tubular bag packaging machine of the afore-mentioned type, with sterile conditions of the said machine, after pre-sterilization, being maintained.

2. Description of the State of Art

Following the pre-sterilization step presently of interest, during permanent operation of a machine of the afore-described type, at least one longitudinally sealed tubular strip is formed from a web of packing material supplied in timed sequence from a magazine roll, moving past a sterilizing station. A tubular strip of the afore-described type is then cross-sealed underneath the forming and loading station; the material to be loaded is filled via a metering device through a forming and filling pipe forming an integral part of the machine, into the end of the tube closed at the bottom, withdrawn by a package length and again cross-sealed to form a closed and filled bag pack which is then cut from the subsequent strip, etc. The advance of the web of packing material withdrawn from the magazine roll is within a sterile chamber equally pre-sterilized and under an excess sterile air pressure.

The afore-described method of manufacturing and loading tubular bags under sterile conditions has been described, for example, in German Patent Application DE 199 10 485 A1, requiring, prior to commencement of the repeat permanent operation, a pre-sterilization of the sterile space, of the metering device metering the material to be loaded, and of the forming and loading station located in the end area of the sterile space and consisting of one or more forming and filling pipes. To the extent as known in the art, integrated into the said pre-sterilization process is the tube of packing material formed by longitudinal sealing into a tube and cross-sealed by cross-sealing jaws arranged externally of the sterile chamber thereby enabling the tube to be withdrawn. In order to incorporate, during pre-sterilization, the packing material-sided face of the shaping pipe, on the one hand, and to insure, on the other hand, the discharge of the sterilizing agent, it is imperative for the forming and loading station to be provided not only with a forming pipe but also with a filling pipe disposed concentrically within the forming pipe in order to thereby enable an adequate discharge of the sterilizing agent through an annular gap formed thereby. Concerning dual tubes of this type, reference is made, for example, to European Patent Application EP-A-0 232 943; German Patent Application DE-A-195 10 555 A1 and to U.S. Pat. No. 4,537,007. According to the two formermentioned literature references special means, such as adjustable dual valves or separately removable closure caps, are additionally provided in order to apply, internally and externally, sterilizing agent to the pipes, with the sterilization being restricted to the loading material-sided face of the packing material. In the packaging machine according to U.S. Pat. No. 4,537,007, the packing material first moving through a sterilizing bath, will pass two sterile chambers separated from one another in order to be steam-dried in the first chamber and to be loaded in the second chamber after cross-sealing having been effected therebelow or outside thereof. The packaging machine according to the afore-mentioned DE-A-199 10 458 A1 also operates on dual pipes of this type, i.e. on a loading pipe concentrically arranged within the forming pipe. In addition, it should be noted that in one form of embodiment of the afore-going machine the dual tube, for pre-sterilizing purposes, is required to be withdrawn from the tube already formed.

The present invention proceeds from the said DE-A-199 10 485 A1 because the basic principle thereof, i.e. withdrawing the web of packing material from a magazine roll and moving the same past a packing web sterilizing station, with a single sterile chamber attached thereto for sterilizing a web of packing material, wherein the forming and loading station is integrated into the end region of the sterile chamber, has proved successful.

SUBJECT MATTER AND SUMMARY OF THE INVENTION

Referring to the afore-described verified state of art, the problem underlying the invention and the object of the invention, respectively, reside in simplifying the required pre-sterilizing method for packing or tubular bag-manufacturing and filling machines of this type and in improving the machine itself to the effect that only one pipe is required per bag strip, i.e. one pipe serving as a forming pipe and at the same time as a loading pipe with no valve required and the arrangement being stationary.

This problem, in the practice of the invention, for pre-sterilizing a tubular bag packaging machine of the afore-mentioned type, has been solved by the following pre-sterilizing steps:

1.1 sterilizing the device metering the material to be loaded by saturated steam;

1.2 after termination of the supply of steam, supplying sterile air to the meter and to the sterile chamber, maintaining the supply of sterile air during subsequent steps;

1.3 withdrawing the web of packing material from the magazine roll through the sterile chamber partially kept open for withdrawing the web while forming tubes down to underneath the forming station;

1.4 closing the sterile chamber and supplying a mix of sterile agent and steam to the sterile chamber, with the tube of packing material kept open or being opened at the bottom;

1.5 after completion of the sterilizing phase by the mix of sterile agent and steam, the sterile chamber and all elements contained therein are dried by the flow of sterile air maintained;

1.6 after drying, the supply of sterile air to the meter is discontinued while the supply thereof to the sterile chamber is maintained;

1.7 subsequently, the tube end formed by cross-sealing and respectively withdrawn by the length of a bag is loaded via the metering device.

What is essential and crucial of the invention is that the tubular web of packing material behind the outlet from the sterile chamber and the permanent supply of sterile air thereto be specifically kept open or be opened; in this connection it should be noted that the alternative statements "kept open or be opened" convey that, on the one hand, the provision of the machine with a new magazine roll and, on the other hand, an interruption of the permanent operation of the machine have been taken into account; in the latter instance, the tube having a cross-sealing, underneath the outlet, suspends from the sterile chamber.

When re-furnishing the machine with a web of packing material, threading thereof into the machine and forming thereof on the forming pipe, the tube formed on the forming pipe by longitudinal sealing is withdrawn by the cross-sealing jaws; however, the latter have not been heated yet nor do they have reached the sealing temperature with the result that no cross-sealing takes place, i.e. the tube after resetting of the cross-sealing jaws, will remain open and not kept in tight abutment with the forming pipe, which is a requirement for enabling the supplied mix of sterile agent and steam (or steam as a carrier for hydrogen peroxide) to enter the gap between packing material and forming pipe, to flow therethrough and get discharged by simply flowing off downwardly through the open-ended tube. Alternatively, a gap between tube and forming pipe can be formed otherwise, if need be, by way of addition, yet to be described hereinafter.

However, the same effect results in the second instance, i.e. in the event of an interruption of operation which requires, as a rule, a renewed pre-sterilization and, in the majority of interruptions, will be overcome by re-threading the web of packing material. Otherwise, the already cross-sealed end of the tube will be pointedly cut off (optionally, in case of an interruption of the supply of filling material, after producing a number of empty bags), thereby, again, forming an open end of the tube. Apart from another measure yet to be explained in this context, the cross-sealing and withdrawing jaws of the machine, for cutting purposes, at the side of the outlet opening can be provided with a cutter; in this respect it is expressly pointed out that said cutter has nothing in common with the cutting elements provided, as a rule, centrally across the entire bag width within the cross-sealing jaws to thereby separate, in timed sequence, a filled bag from the following strip.

As a cut to open the tube as described hereinbefore, optionally, can also manually be carried out by means of scissors, such an additional cutter, admittedly, is of advantage but not imperative, i.e. basically, no changes are required in a conventional packaging machine of the aforementioned type for manufacturing and filling tubular bags to carry out the process of the invention, except for corresponding control means. However, it is of additional advantage that for forming the tube and for supplying the filling material, one tube is adequate as it normally is in non-aseptically operating packaging machines for tubular bags.

At this point, it should be noted that so far, reference has been made to one tube only; it goes without saying that the process of the invention also can be carried out on tubular bag packaging machines that are provided with forming tubes arranged in series and in side-by-side relationship, wherein webs of packing material are processed that are cut into correspondingly thin strips. The same applies to machines for manufacturing so-called three-edge sealing bags wherein a web of packing material of corresponding width is placed about two relatively narrow-spaced tubes, with the longitudinal joint being provided between the tubes at the longitudinal web edges and the web.

BRIEF DESCRIPTION OF DRAWINGS

Although substantially no changes are effected on a tubular bag packaging machine for carrying out the process of the invention, a tubular bag packaging machine and the required accessories thereof are schematically shown for better understanding and explaining the process of the invention, wherein.

DESCRIPTION OF PREFERRED FORMS OF EMBODIMENT

Figure 1:
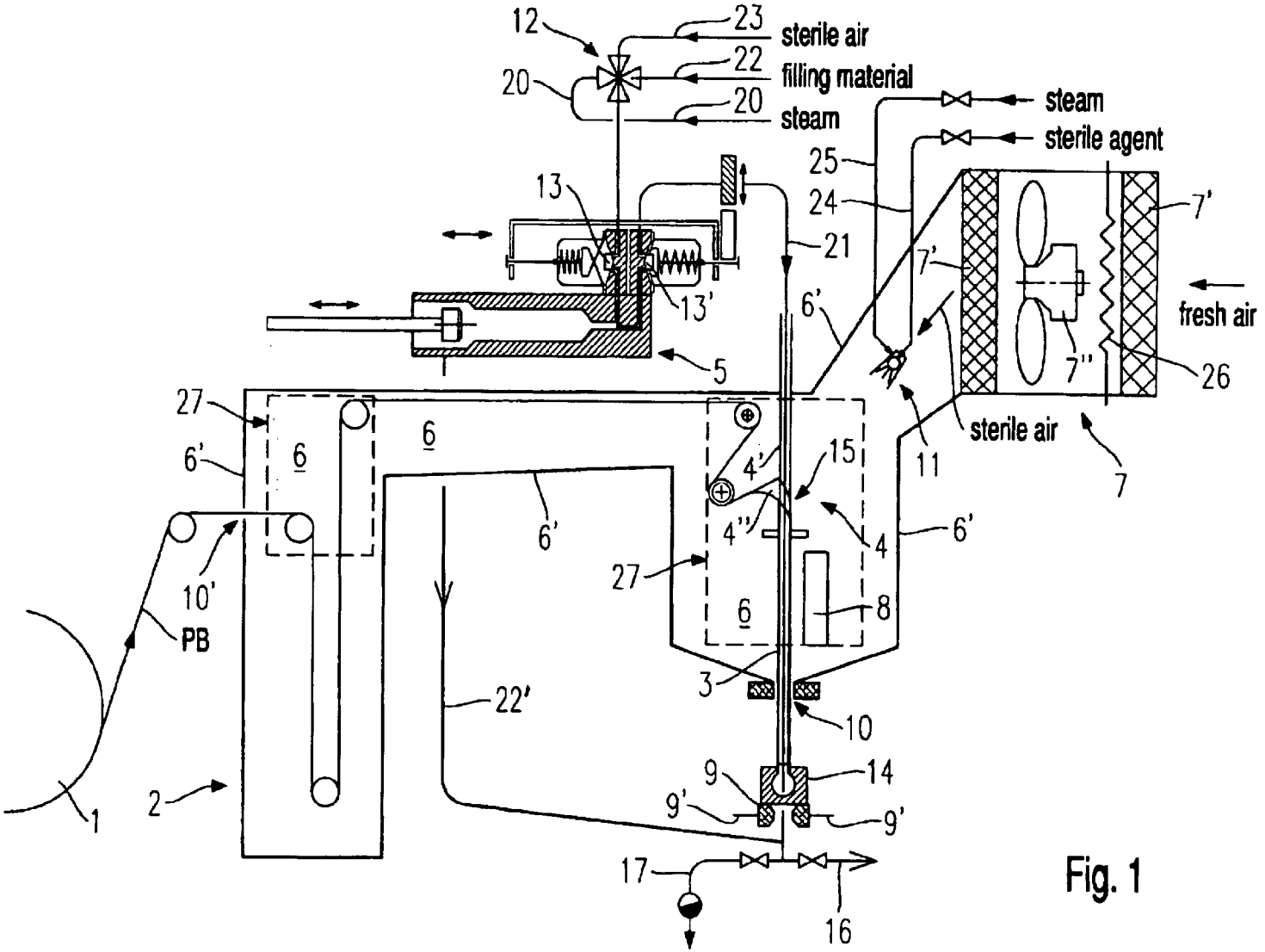
FIG. 1 is a side and sectional view of a tubular bag packaging machine and accessories thereof for supplying the operating means and the material to be loaded.

As disclosed by FIG. 1, the tubular bag packaging machine shown in the form of a one-track machine still comprises, as it did in the past, a holder for holding a packing material magazine roll 1, a sterilizing station 2 to be passed by the web of packing material PB, a forming and filling station 4 including a forming pipe 4' furnished with a forming shoulder 4", a means 5 for metering the material to be loaded and a sterile casing 6' enclosing the sterile chamber 6. Moreover, a sterile air generator provided with filters 7' and a fan 7" is designated by reference numeral 7, the longitudinal sealing jaw by numeral 8, the cross-sealing jaws disposed below the tube opening 10 on the sterile casing 6' by numeral 9 while numeral 11 refers to a special nozzle for introducing the mix of steam and sterilizing agent into the sterile chamber 6. The said nozzle 11 is provided with feed-in conduits 24 and 25 through which sterilizing agent and steam are supplied to be mixed in nozzle 11.

As, in the practice of the invention, after the meter 5 having been sterilized by steam, the same is held, during permanent operation, under sterile air until commencement of the supply of the material to be loaded, meter 5 via a four-way valve 12, is in communication with a sterile air connection 23. It should be noted that, via valve 12, depending on the position thereof, also steam can be passed through conduit 20, while the material to be loaded is passed through conduit 22 into meter 5 provided with inlet and outlet valves 13, 13'.

The said meter 5 and the valves 12 and 13, 13' are conventional elements so that no special description thereof is required.

Figure 5:
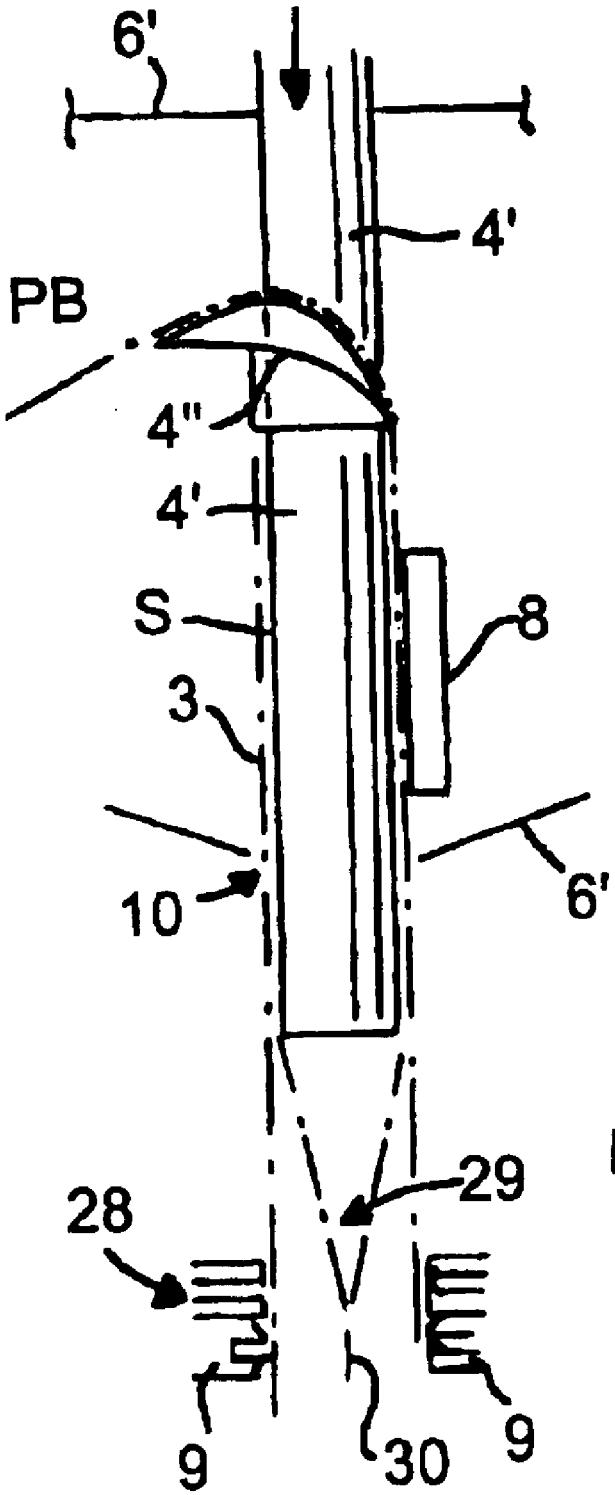
FIG. 5 is a schematically shown side view of the forming pipe and its forming shoulder, at the same time serving as a filling pipe which is enlarged over FIG. 1.

The cross-sealing jaws 9 equally known in the art, according to common practice, are provided with cross cutters 9' cutting the filled and sealed bags from the subsequent strip during permanent or normal operation, i.e. after pre-sterilization which alone is presently of interest. FIG. 5 schematically shows another cutting means 28 optionally to be arranged above the cross-sealing jaw 9, cutting, in a correspondingly controlled way, the end 29 of the tube 3 optionally disposed above a cross sealing joint 30 and arranged beneath the end of the forming pipe 3 for the purpose of opening the same.

To insure as far as possible that, within the scope of the pre-sterilizing process of the invention, an adequate annular gap S be provided between the packing material tube 3 and the forming/filling pipe 4', the tube 3 formed from the web of packing material PB is of a slightly larger outer diameter than the forming pipe 4'. This is simply reached in that the forming shoulder 4" compared to the forming pipe 4' of an irrelevantly smaller diameter as shown in FIG. 5, is dimensioned and shaped accordingly. The annular gap S formed between tube and forming pipe 4', with tube 3 still open between forming shoulder and longitudinal sealing jaw 8, is accessible at 15 for the admitted mixture of steam and sterilizing agent which, in the practice of the invention, can easily flow off at the bottom to the atmosphere through tube 3 which is kept open or which is opened.

For purifying and sterilizing the metering device 5, advantageously, a collector 14 is provided enclosing the tube end and the open end of the tube and being furnished with a connection 16 for the purification phase (CIP) and a connection 17 for the steam sterilizing phase. After purification and steam sterilization of meter 5, the said collector 14 is simply removed.

It appears that a description of the entire machine control for the pre-sterilizing phase of the invention and also for the subsequent normal operation where the assembly is only under a slight excess pressure of the sterile air permanently supplied by the sterile air generator 7 and preventing ingress of germs at the entrance of the packing material web 10' and at the tube opening 10, can be foregone as such a control results, mutatis mutandis, from the process steps of the invention.

Figure 2:
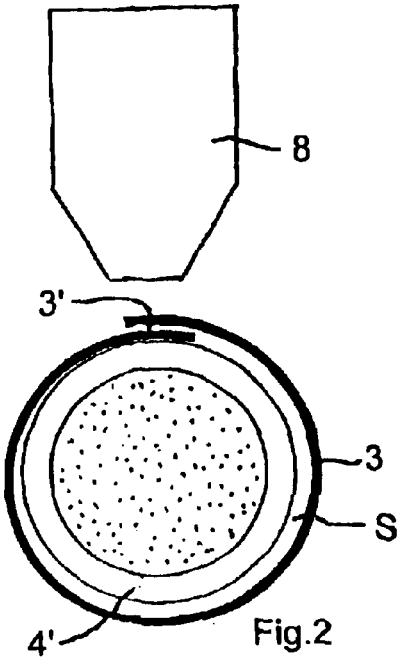
FIGS. 2 to 4 are cross-sectional views of different forming pipe arrangements along with the respectively formed packing material tubes.
Figure 3:
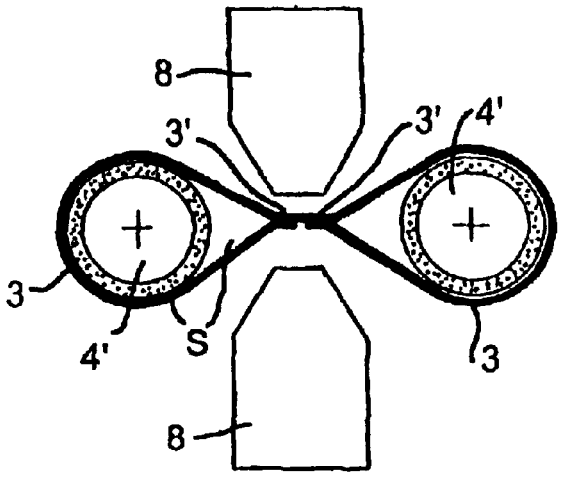
Figure 4:
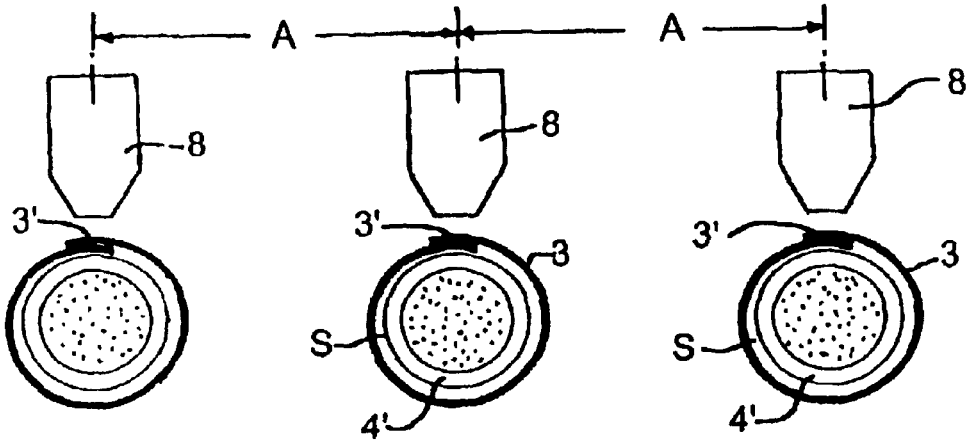

For the sake of completeness, FIGS. 2 through 4 show sectional views of different forming pipe arrangements on tubular bag machines.

FIG. 2 shows a machine comprising only one forming pipe 4' on which is formed a tube 3 from a packing material web of a corresponding width, whereas in the example of embodiment according to FIG. 3 so-called three-edge sealed bags are formed on forming pipes 4' associated in parallel, with two tubes 3 initially attached to one another in the longitudinal direction are being on both pipes 4' from a packing material web of a corresponding width. These two pipes 3, prior to their being isolated into individual bags, can then be separated from one another in the longitudinal direction.

In the form of embodiment according to FIG. 4, for example, three forming pipes 4' are provided on the given machine in correspondingly spaced relationship (space A as shown, is, in fact, slightly larger), on which (forming pipes 4') three separate tubes 4' are formed, with the web of packing material advancing toward the forming pipes 4' being previously divided by two longitudinal cuts, in known manner, into three strips of corresponding width, from which are then formed corresponding isolated bags as shown in FIG. 2. All longitudinal sealing joints formed by the longitudinal sealing jaws 8, in the examples of embodiment according to FIGS. 2 through 4 are designated by reference numeral 3'.

Irrespective of the type of bags manufactured on the given machine under sterile conditions, the required pre-sterilizing process, based on FIG. 1, is carried out as follows:

First the so-called CIP purification of meter 5 is effected by means of a cleansing fluid supplied through conduit 22, with valve 12 correspondingly positioned, followed by the sterilization (by means of saturated steam at a temperature of about 120° C.) of meter 5, with valve 12 correspondingly positioned, wherein the steam is supplied through conduit 20, moving past valve 13 and meter 5 as well as valve 13' and, via conduit 21, also flowing through the forming pipe 4' to be discharged through conduit 22'.

Upon completion of this phase and removal of collector 14, valve 12 is re-switched to supply sterile air through conduit 23, so that meter 5 and all related valves and conduits are under sterile air, thereby preventing ingress of germs from the atmosphere from occurring. Moreover the supply of sterile air directly after purification and sterilization of meter 5 involves the advantage that the forming pipe 4' heated more or less by vaporization, under consideration of the web of packing material to be subsequently formed thereon, is cooled more rapidly. Also, the supply of sterile air to the sterile chamber 6 from the sterile air generator 7 will take place already at the end of this phase at the latest, i.e. the said sterile air supply is maintained during the steps to follow.

Now, the web of packing material is manually withdrawn from the magazine roll 1 through the sterile chamber 6 which is required to be partially kept open for the withdrawal of the web, while forming the tubular shape or applying the web of packing material to the forming pipe 4' down to underneath the forming station, i.e. down to the bottom end of the forming pipe 4', respectively. Now, the access ports 27 (only shown in broken lines in FIG. 1) on the sterile casing 6' are closed which (casing) will thereby get under a slight excess pressure of the sterile air. Within the sterile chamber 6 generally closed yet remaining slightly open at 10 and 10', sterilizing agent and steam are supplied to the mixing nozzle 11 through conduits 24, 25 and are conducted in mixed form into the sterile chamber 6, with the said mixture flowing, at 15, also into the annular gap S between tube 3 and forming pipe 4' and flowing off through gap S of the tube open at the bottom.

Upon completion of the sterilization by the mixture of sterilizing agent/steam the sterile air supplied by the sterile air generator 7 and conducted through conduit 23, for drying purposes, advantageously, is introduced at an increased temperature, for which reason a heating element designated by reference numeral 26 is provided in the sterile air generator 7. Upon completion of the drying process, the supply of sterile air to the meter 5 is discontinued via valve 12; however, the other part of the sterile air supplied by the sterile air generator 7 at a temperature decreased again, and conducted to the sterile chamber 6 is maintained from generator 7. By re-switching the valve 12 the supply of filling material to the meter 5 is at the same time initiated and the sterile normal operation started where the tube end formed by cross-sealing and respectively withdrawn by a bag length is filled through meter 5 via conduit 21.

What is claimed is:

1. A method of pre-sterilizing a tubular bag packing machine wherein, in permanent operation, at least one tubular strip is formed from a web of packing material supplied in timed sequence from a magazine roll, the said tubular strip moving past a sterilizing means, and wherein the said tubular strip underneath a forming and filling station is cross-sealed, filled via a loading material meter through a forming and filling pipe of the forming and filling station, withdrawn by a bag length and again cross-sealed and filled, the advance of the web of packing material taking place behind the magazine roll within a pre-sterilized sterile chamber under excess pressure of sterile air, and the pre-sterilization being carried out in the following steps:

sterilizing the loading material meter by means of saturated steam;

upon completion of the sterilization, supplying sterile air to the meter and into the sterile chamber, and maintaining the sterile air supply during the subsequent steps;

withdrawing the web of packing material from the magazine roll through the sterile chamber, partially kept open for the withdrawal of the web while forming a tube down to underneath the forming station;

closing the sterile chamber and supplying a mixture of sterile agent and steam to the sterile chamber, the tube of packing material being kept open or being opened at the bottom;

upon completion of the sterilization by the mixture of sterile agent and steam, the sterile chamber and all elements contained therein are dried by the flow of air maintained sterile;

upon completion of the drying process, the supply of sterile air to the meter is discontinued, yet maintained to the sterile chamber; and subsequently, the tube end formed by cross sealing and withdrawn by a bag length is filled via the meter.

2. A method according to claim 1, wherein the sterile air is blown into the sterile chamber at an increased temperature for drying the sterile chamber and all elements contained therein.

3. A method according to claim 1, wherein the tubular strip formed from the web of packing material, relative to the outer diameter of the forming and filing pipe, is slightly over-dimensioned.

4. A method according to claim 1, wherein a plurality of tubular strips are formed from the web into empty bags by cross-sealing, and the tubular strip just above the last-applied cross-sealing is opened.

5. A method according to claim 1, wherein the meter is purified with a cleansing fluid to remove contaminants, and the cleansing fluid mixed with the contaminants as well as the sterilizing steam are separately discharged through a collector at the end of the forming and filling pipe.

* * * * *